US005837327A

United States Patent [19]

Sue et al.

[11] Patent Number: 5,837,327

[45] Date of Patent: Nov. 17, 1998

[54] METHOD FOR PRODUCING A $TiB_2$-BASED COATING

[75] Inventors: Jiinjen Albert Sue, Carmel; Robert Clark Tucker, Jr., Brownsburg; Antony John Stavros, Carmel, all of Ind.

[73] Assignee: Praxair S.T. Technology, Inc., Danbury, Conn.

[21] Appl. No.: 782,200

[22] Filed: Jan. 10, 1997

Related U.S. Application Data

[63] Continuation of Ser. No. 489,664, Jun. 12, 1995, abandoned.

[51] Int. Cl.[6] ..... C23C 4/10

[52] U.S. Cl. ..... 427/456; 427/455

[58] Field of Search ..... 427/455, 456

[56] References Cited

U.S. PATENT DOCUMENTS 4,650,552 3/1987 de Nora et al. ..... 204/67

4,975,621 12/1990 Fukubayashi et al. ..... 313/633

FOREIGN PATENT DOCUMENTS 55-145145 11/1980 Japan .

*Primary Examiner*—Katherine A. Bareford

*Attorney, Agent, or Firm*—Robert J. Feltovic

[57] ABSTRACT

A $TiB_2$-M coating which consists of greater than 50 vol % $TiB_2$ hard phase particles in a metal or metal alloy (M) matrix that is produced by a thermal spray process using sintered $TiB_2$-M powders. The $TiB_2$-M powders were fabricated by sintering $TiB_2$ powders and elemental metals or metal alloys which were selected to form a desired matrix for the $TiB_2$ particles.

12 Claims, 2 Drawing Sheets

METHOD FOR PRODUCING A $TiB_2$-BASED COATING

This application is a continuation of prior U.S. application Ser. No. 08/489,664 filing date Jun. 12, 1995, now abandoned.

FIELD OF THE INVENTION

The invention relates to a method for producing a $TiB_2$ (titanium diboride)-based coating by thermal spraying a mixture of sintered powders of $TiB_2$ and a metallic component onto a suitable substrate and the coated article so produced.

BACKGROUND OF THE INVENTION

Titanium diboride is a very hard, refractory compound with excellent wear, corrosion, and erosion properties. It also exhibits good electrical and thermal conductivity. Many processes have been developed to produce titanium diboride-based coatings including chemical vapor deposition (CVD), sputtering, electrodeposition, plasma spray synthesis and plasma spray of $TiB_2$-containing powders. The latter method of thermal spraying has been only moderately successful in producing useful coatings. This is largely because of the very high melting point (approximately 3000° C.) of $TiB_2$ and its chemical characteristics. As a result, useful coatings have only been produced with relatively low volume fractions of $TiB_2$ by this technique.

The typical state-of-the-art method of producing thermal spray powders containing $TiB_2$ is to use mechanical mixtures of $TiB_2$ and a metallic alloy. For this purpose, a variety of metallic alloys have been used, usually based on iron or nickel. To improve the microstructure of the resulting coatings by reducing the titanium diboride particle size and enhancing its entrapment in the coating, mechanical alloying of the powders has been investigated. Using this technique, coatings with up to 12 wt. % (approximately 19.5 vol. %) $TiB_2$ have been made. Mechanically blended powders of $TiB_2$ with metallic additions have produced coatings on various substrates. These coatings were relatively porous, and, except for those that contained a boron-containing alloy as a matrix, the hardnesses of the coatings were quite low. For those coatings that contained boron, increased hardness was attributed to a relatively harder matrix.

An object of the present invention is to provide a method for producing a $TiB_2$-based coating from sintered $TiB_2$ powders.

It is an object of the invention to provide a substrate with a $TiB_2$-based coating that has a high density containing a high volume fraction of finely dispersed $TiB_2$ particles.

The above and further objects and advantages of this invention will become apparent from consideration of the following description.

SUMMARY OF THE INVENTION

The invention relates to a method for producing a $TiB_2$-based coating on a substrate comprising the steps:

(a) sintering a mixture of $TiB_2$ powder with powders of a metallic component selected from the group consisting of at least one elemental metal, at least one metal alloy and mixtures thereof to produce a sintered product;

(b) reducing the sintered product of step (a) to powder; and (c) thermally depositing the powders of step (b) on a substrate to produce a $TiB_2$-based coated article.

Suitable substrates for use in this invention can be selected from the group consisting of iron, nickel, cobalt, aluminum, copper, titanium and alloys thereof.

It has been found that thermal spray $TiB_2$-based coatings with a superior microstructure, that is to say, one with a high density containing a high volume fraction of finely dispersed $TiB_2$ particles, can best be achieved by first sintering a mixture of $TiB_2$ with a metallic matrix, subsequently reducing the sintered product to the desired powder size range, and then thermal spraying. In some cases, it was found that even better results can be achieved by blending $TiB_2$ with elemental powders in the proper proportions to achieve the final metallic alloy required after sintering rather than using a prealloyed metallic component as a precursor to sintering. The $TiB_2$-based coatings of this invention consist of greater than 50 volume percent $TiB_2$ hard phase in a metal or metal alloy matrix and preferably greater than 60 volume percent $TiB_2$ hard phase. Preferably, the porosity of the coatings of this invention will be less than 3.0%, more preferably less than 2.5% and most preferably less than 2.0%.

Preferably, the weight percent of $TiB_2$ could be from 40% by weight to 80% by weight of the total weight of the powders in step (b), more preferably from 50% by weight to 70% by weight, and most preferably from 50% by weight to 60% by weight. The range of the powder size of the reduced sintered product should be between −140 and +1250 Tyler mesh size, and more preferably between −325 and +600 Tyler mesh size. The specified metallic matrix that is to be used in the coating will depend on the specific application and environment that the coatings will be used in. For example, $TiB_2$-based coatings could be suitable for use in wear, corrosion and/or erosion resistant applications. The preferred metallic matrix for the $TiB_2$ component of the coating of this invention could be selected from at least one of the group consisting of nickel, chromium, iron, cobalt, molybdenum and alloys thereof. A particularly preferred powder is one having about 60% by weight $TiB_2$, about 32% Ni and about 8% Cr. Particularly preferred substrates for the coating produced from this powder are iron, nickel, cobalt, titanium, and alloys thereof.

The sintered product of step (b) can be prepared by heating the mixture of $TiB_2$ and the metallic matrix component to a temperature from between 850° C. and 1600° C. and preferably between 1000° C. and 1400° C. Preferably, the mixture should be sintered in a vacuum environment such as a vacuum furnace. The sintered product can be crushed to a desirable size depending on the characteristics of coatings for use in a specific application.

Although the coatings of the present invention are preferably applied by detonation or plasma spray deposition, it is possible to employ other thermal spray techniques such as, for example, high velocity combustion spray (including hypersonic jet spray), flame spray and so called high velocity plasma spray methods (including low pressure or vacuum spray methods). Other techniques can be employed for depositing the coatings of the present invention as will readily occur to those skilled in the art.

EXAMPLE

Figure 1A:
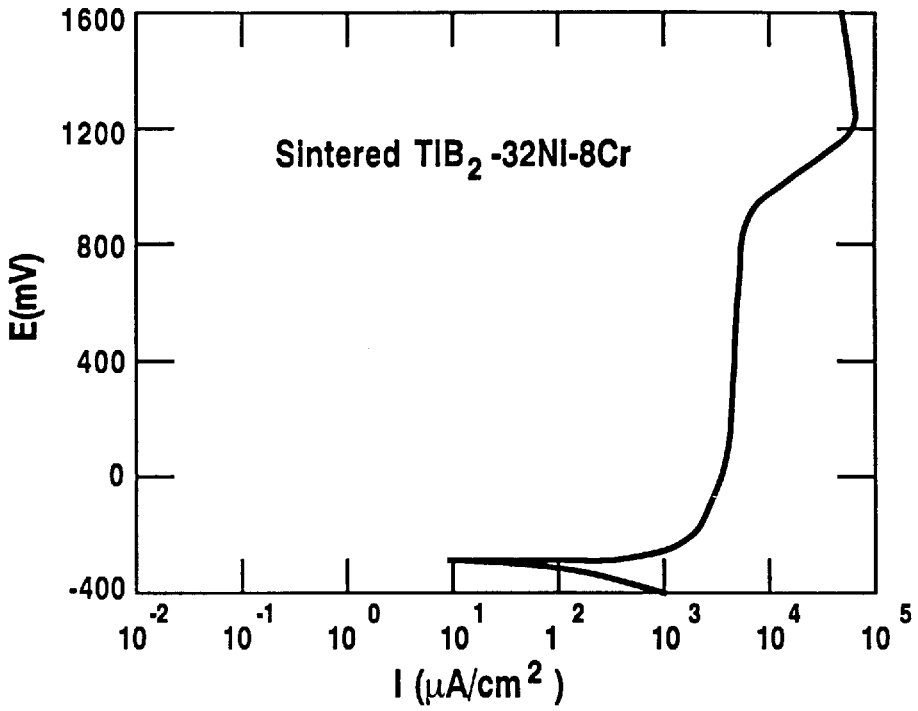
FIGS. 1A, 1B and 1C show the cyclic potentiodynamic corrosion curves for various titanium diboride-based coatings.

To demonstrate the uniquely superior properties of coatings made by the method of this invention, a number of plasma sprayed $TiB_2$ coatings were produced with both sintered and mechanically alloyed $TiB_2$-metal powders. The microstructures, hardnesses, low stress abrasion wear, friction wear, erosive wear, bond strength, and corrosion characteristics of these coatings were determined and compared with other hard coatings.

The compositions, based on weight percent, of the specific coatings used for these evaluations are shown in Table I. The compositions are reported with the numerical figures indicating the weight percent of the metal or metal alloy matrix component, with the remainder of the composition being $TiB_2$. They consist of sintered powders with an overall composition of $TiB_2$—30Ni, $TiB_2$—24Ni—6Cr, $TiB_2$—32Ni—8Cr, $TiB_2$—40Ni—10Cr, and $TiB_2$—32Cr—8MO; and mechanically alloyed powders of $TiB_2$-60(80Ni—20Cr) and $TiB_2$—32Ni—8Cr and mechanically blended alloyed powders of $TiB_2$+30Ni, $TiB_2$—25NiB and $TiB_2$+20Ni. The sintering was performed in a vacuum furnace at 1150° C.–1400° C. for several hours, depending on the melting temperature of the metallic powder materials. Mechanical alloying was carried out by dry milling powders with high speed, stirred tungsten carbide or stainless steel balls in an attriter. The resulting powders were crushed when necessary and sized to the appropriate −325 mesh powder size for plasma spraying. Scanning electron microscopy revealed that the mechanically alloyed powders were enveloped in a metallic alloy as a result of repeated cold welding and attrition, as expected. The sintered powders showed a uniform distribution of the constituents, as desired.

The microstructures of the coatings produced with both sintered and mechanically alloyed powders were superior to those produced with mechanically blended powders. The coatings produced with the mechanically blended powders had much higher porosities than those produced with either sintered or mechanically alloyed powders (greater than 3.5% vs. less than 2.5%). Typically, the coatings deposited with mechanically alloyed powders consisted of very fine titanium diboride particles dispersed throughout the coating, while those produced with sintered powders had relatively larger titanium diboride particles, and large, unmelted metallic particles.

The properties of coatings made using powders prepared by the various techniques were compared in a series of experiments.

Experimental Set 1. The properties of $TiB_2$—32Ni—8Cr coatings produced using sintered and mechanically alloyed powders were compared with those of mechanically blended powders and the results are shown in Tables I and II. The cross-sectional microhardnesses of these coatings were measured using ASTM Standard Test Method G 76-83. The alumina used in this test was nominally 27 micrometers at a particle velocity of 120 m/s. Erosion was measured at both 30° and 90° angles of impingement. The bond strength of the coatings was measured using ASTM Standard Test Method 633-79. The results of these tests are summarized in Table II for coating numbers 1 through 9 of Table I.

The superiority of coatings made from sintered powders as compared to those that are simply mechanically blended is readily evident by comparing, for example, the $TiB_2$—30Ni coatings. The hardness of the sintered coating is almost three times that of the mechanically blended coating, while the sand abrasion and low angle erosion resistance are substantially superior as well.

The relative superiority of coatings produced using sintered powders as compared to those using mechanically alloyed powders is evident by comparing the various properties of the $TiB_2$—32Ni—8Cr sintered coating with the $TiB_2$—32Ni—8Cr mechanically alloyed coating, as shown in Table II.

Figure 1B:
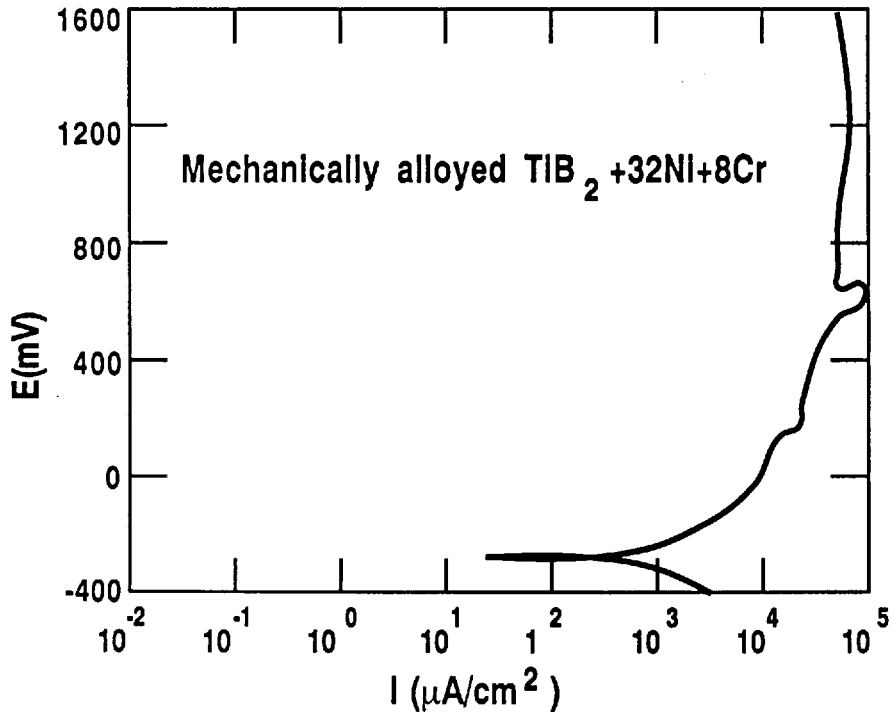
Figure 1C:
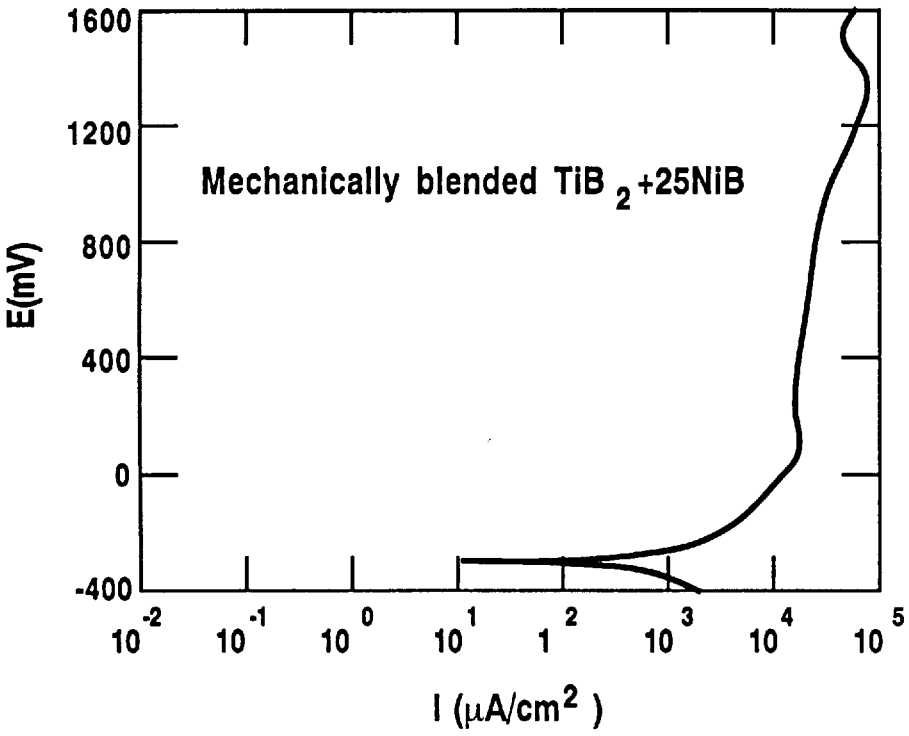

Experimental Set 2. Cyclic potentiodynamic studies of the corrosion characteristics of coatings 3, 7 and 9 in Table I were evaluated using test techniques described in ASTM Designation G61-86 (Designation G61-86 Annual Book of ASTM Standards, 03.02 ASTM, Philadelphia, Pa. 1992). In this test, the coatings were applied to 316 stainless steel substrates. The electrolyte was 1N $H_2SO_4$. The results are shown in FIGS. 1A, 1B and 1C. From this data it can be seen that the corrosion rate, of the coating of this invention is substantially lower than coatings made by the prior art.

Experimental Set 3. Residual stress is an important property of all thermal spray coatings. Residual stress is present in virtually all as-deposited coatings as a result of the cooling of the molten powder droplets on impact on an essentially ambient temperature substrate; and the cooling particles trying to shrink while bonded to a relatively rigid substrate. The result is almost invariably a residual tensile stress in the coating when using plasma spray deposition and most other thermal spray processes. This stress increases as the coating thickness increases until the coating eventually cracks. One means of measuring such stress is by measuring the change in crystal lattice spacing using X-ray diffraction. When this was done on a sample of sintered $TiB_2$—32Ni—8Cr coating (Coating 3), surprisingly, a high compressive stress, rather than tensile, stress of 297±78 MPa was found.

Experimental Set 4. A plasma sprayed coating of this invention was compared with standard detonation gun coatings in an adhesive wear block-on-ring test (ASTM D2714-88) mated against blocks of aluminum alloy 2024-T4. The specific coating of this invention, sintered $TiB_2$—32Ni—8Cr, was applied to the rings and ground to a surface roughness of 18–23 $\mu$in Ra. The test was run at 180 rpm under a 90 lb load for 5,400 revolutions using four different aluminum alloy rolling mill lubricants. The results are shown in Table III. The performance of the plasma sprayed coating is remarkably similar, even superior in some lubricants, to the detonation gun coatings that are currently the standards of excellence in the industry.

Although specific embodiments of this invention have been described, it shall be understood that various modifications may be made without departing from the spirit of the invention.

TABLE I

| Coating Number | Powder Method | Powder Composition Wt. % | Porosity % |
|---|---|---|---|
| 1 | Sintered (ST) | $TiB_2$–30Ni | 2.5% |
| 2 | Sintered (ST) | $TiB_2$–24Ni–6Cr | 1.5% |
| 3 | Sintered (ST) | $TiB_2$–32Ni–8Cr | <1% |
| 4 | Sintered (ST) | $TiB_2$–40Ni–10Cr | >1% |
| 5 | Sintered (ST) | $TiB_2$–32Cr–8Mo | — |
| 6 | Mechanically Alloyed (MA) | $TiB_2$–60(80Ni–20Cr) | <1% |
| 7 | Mechanically Alloyed (MA) | $TiB_2$–32Ni–8Cr | <1% |
| 8 | Mechanically Blended (MB) | $TiB_2$+30Ni | — |
| 9 | Mechanically Blended (MB) | $TiB_2$+25NiB | 6% |
| 10 | Mechanically Blended (MB) | $TiB_2$+20Ni | 3.5% |

TABLE II

| Coating Number | Coating | Hardness HV.3 | Sand Abrasion Wear ($cm^3$/1000 rev.) | Erosion ($\mu m/g$) 30° | Erosion ($\mu m/g$) 90° | Bond Strength (PSI) |
|---|---|---|---|---|---|---|
| 1 | $TiB_2$-30Ni | 1097 ± 130 | 2.2 | 24 | 133 | 9,650 |
| 2 | $TiB_2$-23Ni-6Cr | 1010 ± 130 | 2.1 | 23 | 138 | * |
| 3 | $TiB_2$-32Ni-6Cr | 1019 ± 150 | 2.2 | 24 | 122 | >10,000 |
| 4 | $TiB_2$-40Ni-10Cr | 1010 ± 122 | 2.2 | 27 | 121 | * |
| 5 | $TiB_2$-32Cr-8Mo | 976 ± 82 | 2 | 27 | 133 | * |
| 6 | $TiB_2$-60(NiCr) | 962 ± 58 | 3.3 | 38 | 145 | * |
| 7 | $TiB_2$-32Ni-8Cr | 936 ± 127 | 2.8 | 26 | 131 | * |
| 8 | $TiB_2$+30Ni | 362 | 3.2 | 27 | 108 | * |
| 9 | $TiB_2$-+25NiB | 1028 | 2 | 15 | 169 | * |

TABLE III

Block Wear Scar Widths (in)
90 lbs., 180 rpm, 5,400 rev.

| Coating Type | Lubricant A | Lubricant B | Lubricant C | Lubricant D |
|---|---|---|---|---|
| WC-22Cr-5Ni (DG) | .1812 | .2375 | .1497 | .2085 |
| WC-14Co (DG) | .1620 | .2288 | .0906 | .1034 |
| $TiB_2$-32Ni-8Cr (PS) | .1516 | .0664 | .1511 | .1114 |

(DG) = detonation gun deposition
(PS) = plasma spray deposition

What is claimed:

1. A method for producing a $TiB_2$-based coating on a substrate comprising the steps:

(a) sintering a mixture of $TiB_2$powders with powders of a metallic component selected from the group consisting of nickel, chromium, iron, cobalt and alloys thereof, by heating said mixture to between 850° C. to 1600° C. to produce a sintered product;

(b) reducing the sintered product of step (a) to powders; and (c) thermally depositing the powders of step (b) onto a substrate to produce a $TiB_2$-based article, suitable for use in wear, corrosion and/or erosion resistant applications.

2. The method of claim 1 wherein the mixture of $TiB_2$ powder with the metallic component is sintered to between 1000° C. and 1400° C.

3. The method of claim 1 wherein in step (b) the sintered product is reduced to a powder in a range between −140 Tyler mesh size and +1250 Tyler mesh size.

4. The method of claim 3 wherein in step (b) the sintered product is reduced to a powder in a range between −325 Tyler mesh size and +600 Tyler mesh size.

5. The method of claim 3 wherein the mixture of $TiB_2$ powders with the metallic component is sintered to between 1000° C. and 1400° C.

6. The method of claim 1 wherein powders of step (b) are thermally deposited on a substrate to produce a $TiB_2$-based coating based on a weight percent composition selected from the group of coatings consisting of $TiB_2$—30Ni; $TiB_2$—24Ni—6Cr; $TiB_2$—32Ni—8Cr; $TiB_2$—40Ni—10Cr; and $TiB_2$—32Cr—8Mo.

7. The method of claim 6 wherein the $TiB_2$-based coating based on a weight percent composition is selected from the group of coating consisting of $TiB_2$—32Ni—8Cr and $TiB_2$—24Ni—6Cr.

8. The method of claim 1 wherein the substrate is selected from the group consisting of iron, nickel, cobalt, aluminum, copper, titanium and alloys thereof.

9. The method of claim 8 wherein the substrate is iron or iron alloys and the $TiB_2$-based coating based on weight percent composition is $TiB_2$—32Ni—8Cr.

10. The method of claim 8 wherein the substrate is nickel or nickel alloys and the $TiB_2$-based coating based on weight percent composition is $TiB_2$—32Ni—8Cr.

11. The method of claim 8 wherein the substrate is cobalt or cobalt alloys and the $TiB_2$-based coating based on weight percent composition is $TiB_2$—32Ni—8Cr.

12. The method of claim 8 wherein the substrate is titanium or titanium alloy and the $TiB_2$-based coating based on weight percent composition is $TiB_2$—32Ni—8Cr.

* * * * *